US005730838A

United States Patent [19]

Glasner

[11] Patent Number: 5,730,838

[45] Date of Patent: Mar. 24, 1998

[54] PROCESS FOR EXTRACTING PURE, COARSE GRAIN SILICIC ACID CRYSTALS FROM SPENT LYE

[75] Inventor: Alfred Glasner, Passail, Austria

[73] Assignee: Austrian Energy & Environment SGP/Waagner-BIRO GmbH, Vienna, Austria

[21] Appl. No.: 669,434

[22] PCT Filed: Dec. 22, 1994

[86] PCT No.: PCT/AT94/00202

§ 371 Date: Jun. 21, 1996

§ 102(e) Date: Jun. 21, 1996

[87] PCT Pub. No.: WO95/17547

PCT Pub. Date: Jul. 29, 1995

[30] Foreign Application Priority Data

Dec. 23, 1993 [AT] Austria ..... 2608/93

[51] Int. Cl.[6] ..... D21C 11/00

[52] U.S. Cl. ..... 162/29; 162/16; 162/30.1; 423/325

[58] Field of Search ..... 162/16, 29, 30.1, 162/30.11; 423/325

[56] References Cited

U.S. PATENT DOCUMENTS

| | | | |
|---|---|---|---|
| 4,331,507 | 5/1982 | Roberts | 162/29 |
| 4,504,356 | 3/1985 | Mulder et al. | 162/29 |

FOREIGN PATENT DOCUMENTS

| | | | |
|---|---|---|---|
| 0431 337 A1 | 6/1991 | European Pat. Off. | D21C 11/04 |
| 3003090 | 8/1981 | Germany | C02F 1/60 |
| 2 065 188 | 6/1981 | United Kingdom | D21C 3/02 |

*Primary Examiner*—Karen M. Hastings

*Attorney, Agent, or Firm*—Steinberg, Raskin & Davidson, P.C.

[57] ABSTRACT

A process is disclosed for extracting pure, coarse-grain silicic acid crystals from silicic acid-containing spent lye in cellulose production, comprising adding coarse-grain silicic acid to alkalized spent lye, lowering the pH of the alkalized spent lye to about 9 such that a sediment is formed, separating the sediment formed into coarse grain and fine grain silicic acid with little lignin and lignin-containing spent lye free from silicic acid, and separating the coarse grain and fine grain silicic acid with little lignin into course grain silicic acid and lignin. At least part of the course grain silicic acid separated is fed back to the alkalinized spent lye to be desilicified.

15 Claims, 1 Drawing Sheet

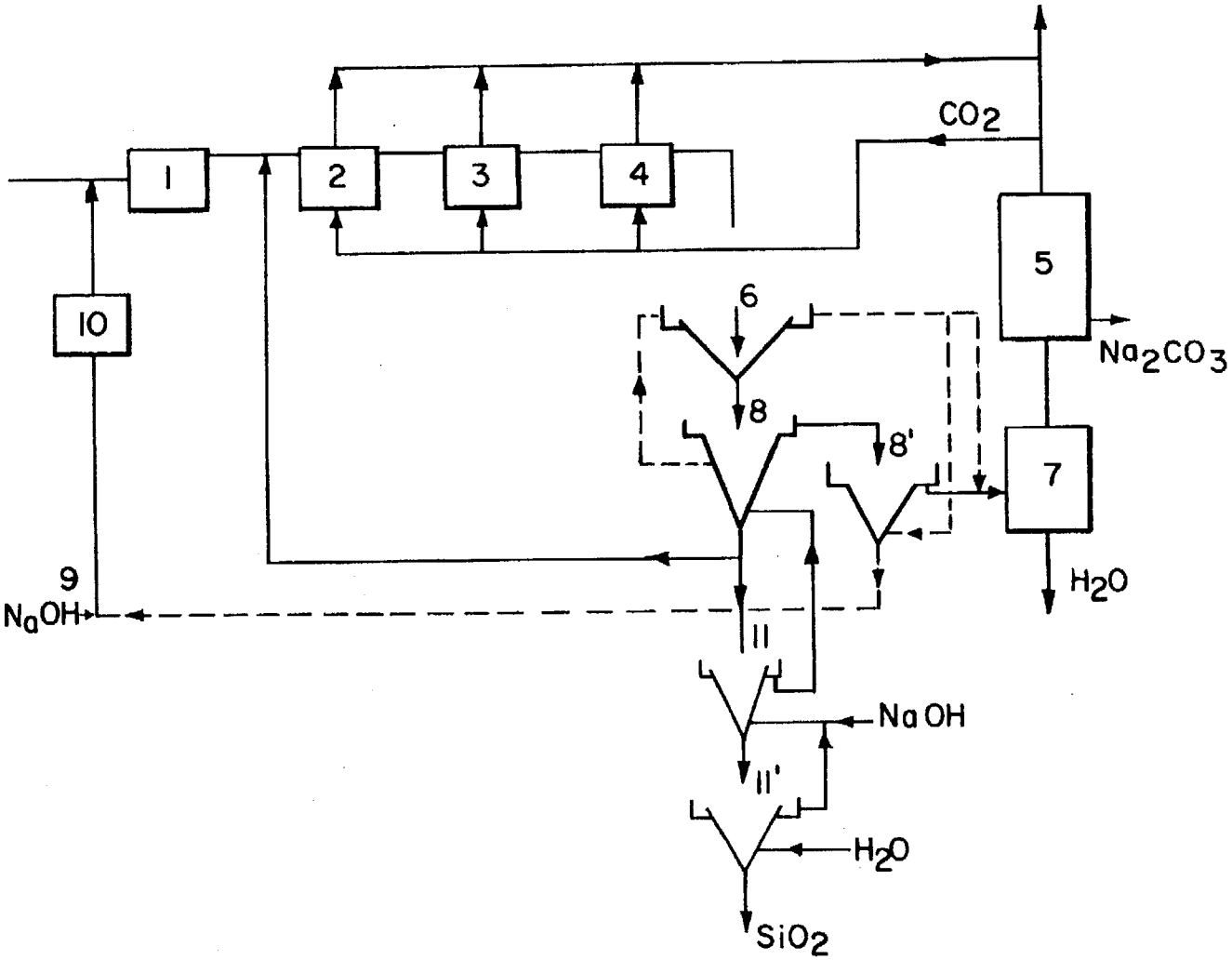
1
2
3
4
5
6
7
8
8'
9
10
11
11'
$CO_2$
$Na_2CO_3$
$H_2O$
NaOH
$H_2O$
$SiO_2$
NaOH

PROCESS FOR EXTRACTING PURE, COARSE GRAIN SILICIC ACID CRYSTALS FROM SPENT LYE

FIELD OF THE INVENTION

The invention relates to a process for extracting pure, coarse grain silicic acid crystals from silicic acid-containing spent lye in cellulose production, in particular the processing of annual plants.

BACKGROUND OF THE INVENTION

A method by which silicic acid is separated from a pre-concentrated waste liquor by means of exposure to $CO_2$ is known, as disclosed in DE-A1-3208200 or U.S. Pat. No. 2,504,356. Furthermore, EP-A-0431337 discloses a method by which the spent lye of cellulose digestion of annual plants is exposed to $CO_2$ to slowly lower the pH, whereby the silicic acid is precipitated and most of the lignin remains in the solution during the lowering of the pH to about 10.2. According to the process disclosed in EP-A-0431337, the lignin separation is suppressed by limiting the pH lowering, and the silicic acid is precipitated at a relatively slow rate. By inoculating the spent lye with precipitated silicic acid, the extraction is improved, but cost of equipment is expensive.

In order to rapidly attain a high degree of desilification it is necessary to lower the pH value further. At pH values below 10, however, more lignin is precipitated. Although this facilitates sedimentation and coarsening of the silicic acid grain in a desirable manner, return of the precipitated silicic acid to the precipitation device leads to an undesirable enrichment in the desilification steps, thereby hindering the precipitation of the silicic acid. Therefore, further lowering of the pH would make it possible to accelerate the extraction, except that the lignin content of the spent lye for depletion of silicic acid is increased such that silicic acid can no longer be removed. For example, the dissolved silicic acid contents in rice straw are approximately 10% $SiO_2$ dry substance, with 100 g/l dry substance of the spent lye being thus dissolved at 10 g/l $SiO_2$. When the pH value is lowered, up to 5 g/l of lignin can however be precipitated, causing a high proportion of organic material to be contained in the produced sludge.

It is therefore desirable to produce a coarse-grain silicic acid in the form of a saleable product by a process in which the lignin remains in the spent lye to increase useful fuel output in the lye combustion furnace.

SUMMARY OF THE INVENTION

It is the object of the present invention to obtain pure, coarse grain silicic acid by a stable process and to return the co-precipitated lignin into the liquification and subsequent combustion phases.

It is the object of the present invention that alkalized spent lye from cellulose production is inoculated with coarse-grain silicic acid, the pH value is then lowered preferably to about 9, the sludge produced as the pH value is lowered is separated during its sedimentation into coarse grain and fine grain silicic acid with a small amount of lignin and into lignin-containing, silicic acid depleted spent lye, and the coarse grain silicic acid is separated from the lignin in a washing device and the seaprated lignin is mixed into the lignin-containing spent lye.

It is an object of the present invention that part of the coarse-grain silicic acid is fed back into the first silicic acid precipitation step for inoculating and that withdrawal of the excess silicic acid takes place discontinuously.

It is an object of the present invention that the lignin-containing, in particular coarse grain silicic acid is fed back into the desilification cycle after washing, preferably by means of a partial flow of the desilified spent lye, if necessary with the addition of carbonates or hydroxides and a separation of the lignine.

It is an object of the present invention that the silicic acid obtained in the overflow of the washing phase is introduced directly into the spent lye to be desilicified in the alkalizing container or in a dissolving container upstream of same.

It is an object of the present invention that the pH value of the spent lye in the individual precipitation steps is equal to approximately the pH value of a relative silicic acid oversaturation of the spent lye of less than 3.

It is an object of the present invention that the silicic acid contents in all precipitation steps is maintained above 10 g/l through backfeeding of coarse crystal silicic acid and in that the silicic acid precipitated per hour in the step is equal to approximately 10% of the total amount of silicic acid present in the step which was introduced into the crystallization step through innoculation.

It is an object of the present invention that the fine grain silicic acid is brought together with the lignin into an additional categorization and washing step and in that the lignin is introduced into the desilified spent lye while the fine grain silicic acid is introduced into the spent lye to be desilified.

It is an object of the present invention that the removal of the coarse silicic acid takes place throughout one or several washing and classification steps in opposing flow, whereby an increase of the pH value is carried out in the first washing step in the washing water of the classifier and in that the wash water overflow of the last classification step with a low content in dry substances is introduced into the acquisition of the fiber line and in that the wash water of the first classification step is introduced into the spent lye to be desilified before the precipitation reactors of the desilification system.

It is an object of the present invention that hydrocyclones, centrifuges and/or washing filters are used for the washing and classification, in particular for the separation of the silicic acid suspension in the course of the last precipitation step, and in that the washed silicic acid slurry containing more than 300 g/l of dry substances is collected in a dewatering pit and in that the wash water produced is fed back into the washing step.

According to the above and other objects, in the process of the present invention, alkalized spent lye is inoculated with coarse-grain silicic acid and the pH of the resulting mixture is decreased, preferably to about pH 9. The sludge which sediments from the mixture during the pH lowering is separated into coarse grain and fine grain silicic acid having only small amounts of lignin and into lignin-containing spent lye free of silicic acid. The coarse grain silicic acid is separated from the lignin in a washer and the separated lignin is mixed into the lignin-containing spent lye.

BRIEF DESCRIPTION OF THE DRAWING

FIG. 1 is a schematic depiction of the process of the present invention.

DETAILED DESCRIPTION OF THE INVENTION

In a process for separating coarse-grain, pure silicic acid crystals from silicic-acid-containing spent lye in cellulose production, a spent lye is alkalized to a pH of at least 11 through the addition of lye. Desilification, through lowering the pH by means of gases containing $CO_2$, is carried out in a chain of precipitation vessels until the desired residue of silicic acid is obtained. The precipitated silicic acid is separated from the spent lye by sedimentation.

In the process of the present invention, the alkalized spent lye is inoculated with coarse-grain silicic acid and its pH is then lowered to about 9. The sludge produced during sedimentation of the inoculated spent lye as the pH is lowered to about 9 is separated into coarse grain and fine grain silicic acid with little lignin content and into lignin-containing spent lye free of silicic acid. The coarse grain silicic acid is separated from the lignin in a washing device and the separated lignin is added to the lignin-containing spent lye.

Separation of the lignin precipitated at the same time as the coarse crystal silicic acid from the spent lye is brought about due to the fact that its sedimentation effect differs from that of the lignin. Silicic acid has a much smaller specific surface, and spent lye together with the lignin crowd out the remaining gap volume by the high sludge density. If the precipitation of a silicic acid with coarser distribution of grain size is desired, this causes a considerable reduction of the active surface. This reduction is undesirable and unavoidable. It is therefore necessary to attempt increasing the lost surface by means of a recovered, large quantity of innoculated silicic acid.

A high specific sludge density with $SiO_2$ contents of, e.g., approximately 300 g/l ensures a small innoculated sludge quantity. With the obtained sludge density this can be kept at approximately 10% of the spent lye to be desilicicated. This has the favorable effect that the filter surface can thereby kept small. Also, the volume of the reactor is increased only by a small amount if a dwell time is observed.

An evaluation of the surfaces in function of grain size distribution shows that a suspension with a median of more than 20 μm has a surface of 10 $m^2$/l for 30 g/l silicic acid as compared with 5 μm median 32 $m^2$/l for 10 g/l silicic acid. All together this results in a surface reduction of approximately 90% for the same contents of silicic acid. This surface reduction must therefore be compensated for through inoculating. If a uniform crystallization rate relative to the crystal surface is desired, the amount of silicic acid inoculating must be increased or a correspondingly longer dwell time must be observed in the precipitation steps.

The following are several test values:

| Test | Crystal growth speed | Grain size in μm | Silicic acid quantity in g/l | Reactor volume g/h/l |
|---|---|---|---|---|
| 1 | 0.5 | 2–5 | 10 | 10 |
| 2 | 0.05 | 18 | 6 | 0.3 |
| 3 | 0.025 | 20 | 30 | 3 |

Since a grain size as in test 3 is desired, the load of the reactor should be kept low so that the volume in the reactor can increase. Greater load results in a faster crystal growth rate and accordingly greater oversaturation which carries with it the danger of secondary nucleation. Oversaturation however also means delayed precipitation and thereby lower effectiveness. When higher loads are desired it is therefore necessary, in order to reduce the massive oversaturation found especially in the first step and in order to achieve a high degree of desilification in further precipitation steps, innoculating should be carried out in the first step. Although a 5 times higher crystal growth speed was achieved in the tests, a larger grain size could also be obtained and the desilification degree could be increased from approximately 90% up to 98%. During the tests it was found that the oversaturation after starting up following a week-end was greater than after one or two days of constant operation. In this case the surface of the innoculated crystals, grain size remaining equal, is reduced due to recrystallization, with faulty spots being evened out. After 2 weeks stoppage it was even possible to find octahedrons of 50 μm.

Through categorization (separation) and subsequent dissolution of the silicic acid crystals in the spent lye to be desilified, the nucleation count in the recovered silicic acid sludge can be reduced. Secondary nucleation is avoided by inoculation and by reduction of oversaturation (not over 6). An especially advantageous solution is obtained if the pH value of the spent lye in the different precipitation steps is equal to the pH value of a relative silicic acid oversaturation of less than 3 of the spent lye, so that the reduction of new nuclei is especially effective. The mechanical formation of secondary nuclei as a result of abrasion is avoided by low flow speeds (less than 2 m/sec) and low energy density in the gas reactors and pumps or by high effectiveness. The fine silicic acid particles separated in the categorization can now be dissolved again in the alkaline environment at high pH value, and can then be returned to the beginning of the first crystallization step.

At pH values of less than about 10.5, lignin may sediment to an increasing extent and the resulting large volume of sludge may render the jellification or thickening of the silicic acid impossible. Since lignin becomes increasingly soluble at pH values greater than 10, the silicic acid sludge can be cleaned for innoculating in a high suspension density (of approximately 300 g/l) and can be recovered.

In the appended diagram the liquor to be desilified following a sedimentation process in which solids such as fibers and foreign bodies are eliminated, is fed into a dissolution container 1 for alkalization and is alkalized to a pH value of at least 11, preferably 11.8. The spent lye goes with dropping pH value through successive crystallization steps, each of which take place in precipitation vessels 2, 3 and 4. At least two crystallization steps are performed. The pH is lowered step by step by the addition of $CO_2$ into each precipitation vessel from the exhaust gas of the lye combustion burner 5. The pH is lowered preferably in three gradations from at least 11 to about 10.5, then to about 10.2 and then to a level from about 9 to about 10 in the three crystallizations occurring in precipitation vessels 2, 3 and 4. In particular in the last crystallization step 4, a fine form of lignin is precipitated as sludge lignin, which is conveyed through a first filter 6 and with the desilified spent lye, goes to boil-down system 7. This suspension is thickened there possibly in admixture and is burned in the lye steam furnace.

The generated water is recirculated or is fed into the acquisition of the fiber line of the cellulose process. The contents in silicic acid is kept in all precipitation steps higher than 10 g/l through recycling into coarse crystalline silicic acid and the silicic acid precipitated per hour in the step which represents approximately 10% of the total silicic acid present in the step is conveyed to the crystallization step by means of inoculating.

In the filter 6, an underflow of fine and coarse grain silicic acid heavily polluted by lignin accumulates and is separated in a categorization device 8 possibly having several steps into coarse and fine grain silicic acid minimally polluted by lignin as well as into lignin slurry. The lignin slurry is conveyed into the boil-down installation 7 and the separated silicic acid is in part returned to the crystallization installation. In order to reduce the water burden, categorization device 8' is operated by a partial stream of the desilified spent lye. The fine-grain, sludge-like silicic acid which is separated here is dissolved by the addition of soda lye 9 in a second dissolution reactor 10 and is only then mixed with the lye to be desilified.

Accordingly, the removed lignin is separated from the precipitated silicic acid and fed into the silicic-acid-depleted spent lye in order to raise its useful fuel content. Utilization of additional fuels, therefore decreases. It is essential here that as much silicic acid as possible be removed from spent lye used for the washing of precipitated silicic acid, so that the water content of the spent lye to be burned is not increased, and the furnace can be used in its existing size.

The coarse-grain silicic acid fraction is fed in major part to the first crystallization vessel 2 for inoculating and raising of the silicic acid contents of the spent lye to be desilified. It is advantageous to carry out this addition even before entry into the first crystallization step 2 (higher pH value), so that the lignin which is present is certain to be dissolved so that the crystals are therefore better able to grow. The smaller portion of the coarse-grain silicic acid fraction being withdrawn discontinuously in form of overflow sludge is again washed in a multi-step categorization device, possibly discontinuously in the washing steps 11, 11', and is produced in saleable purity. To improve the washing results, the washing water is alkalized by means of NaOH addition in the first washing step 11, so that the alkalinity in the first step of the classification device 8 increases the alkalinity already in the first step of categorization device 8 and the separation effect is thus improved.

The relative oversaturation of the spent lye serves as a control mechanism for the recycling of the coarse grain silicic acid, this being the ratio of the dissolved silicic acid in the precipitation step (crystallization step) to the theoretic solubility of the silicic acid at the pH value of the respective liquid in the crystallization step to be extracted and its temperature. This procedure makes it possible to achieve a desilification of up to 98% so that no difficulties arise in the lye combustion.

Within the framework of the invention it is advisable to reduce the water content of the spent lye to be thickened. It is advisable to operate the washing and categorization steps in opposing stream and to introduce the washing liquid of the last categorization step with little dry-substance contents into the fiber line of the cellulose plant. It is also economically advantageous to collect the washed silicic acid with dry substance contents of more than 300 g/l in a dewatering pit and to feed the washing water back into the washing step.

I claim:

1. A process for extracting pure, course-grain silicic acid crystals from silicic acid-containing spent lye in cellulose production, comprising:

(a) adding coarse-grain silicic acid to alkalized spent lye;

(b) lowering the pH of the alkalized spent lye to about 9 such that a sediment is formed in the spent lye;

(c) separating the sediment formed in accordance with step (b) into a mixture of (i) coarse and fine grain silicic acid and lignin and (ii) lignin-containing spent lye free from silicic acid;

(d) separating coarse grain silicic acid from mixture (i) of step (c); and (e) separating lignin from mixture (i) to provide pure, coarse-grain silicic acid.

2. The process as in claim 1 where at least part of the separated coarse grain silicic acid from step (d) is added to the alkalized spent lye in step (a).

3. The process as in claim 2 where the at least part of the separated coarse grain silicic acid is added discontinuously to the alkalized spent lye.

4. The process as in claim 1 further comprising adding the lignin from step (e) to lignin-containing spent lye free from silicic acid to provide a fuel composition.

5. The process as in claim 1 in which the pH of the alkalinized spent lye is lowered successively by exposing the alkalized spent lye in a first vessel to a gas comprising $CO_2$ and transferring the alkalized spent lye from the first vessel to a second vessel and exposing the alkalized spent lye in the second vessel to a gas comprising $CO_2$.

6. The process as in claim 1 in which the mixture of coarse grain and fine grain silicic acid and a small amount of lignin is washed such that coarse grain silicic acid is obtained, further comprising feeding said coarse silicic acid to the spent lye prior to step (c).

7. The process as in claim 6 in which a material selected from the group of a carbonate and a hydroxide is added to the coarse grain silicic acid to the spent lye prior to step (c).

8. The process as in claim 6, in which silicic acid obtained in an overflow of the washing is added to the spent lye to be desilified prior to step (c) of claim 1.

9. The process as in claim 1, in which the pH value of the spent lye during the sedimentation of the spent lye is approximately the pH value of a relative silicic acid oversaturation of the spent lye of less than 3.

10. The process as in claim 5, in which the silicic acid concentration in all precipitation steps is maintained above 10 g/l through backfeeding of coarse crystal silicic acid and in that the silicic acid precipitated per hour in the step is equal to approximately 10% of the total amount of silicic acid added to the spent lye prior to step (c) of claim 1.

11. The process as in claim 1, further comprising categorizing and washing fine grain silicic acid and lignin and adding the lignin to the desilified spent lye while the fine grain silicic acid is added to the spent lye to be desilified.

12. The process as in claim 1, in which removal of the coarse silicic acid takes place throughout one or several washing and separation steps in opposing flow, whereby an increase of the pH value is carried out in a first washing step in a filter with wash water and in that the wash water overflow of the last separation step with a low content of dry substance is introduced into a fiber line of the cellulose production and in that the wash water of the first separation step is introduced into the spent lye to be desilified.

13. The process as in claim 12, where hydrocyclones, centrifuges and/or washing filters are used for the washing and separation, and in that the washed silicic acid slurry containing more than 300 g/l of dry substances is collected in a dewatering container and in that the wash water produced is fed back into the washing step.

14. A process for separating coarse-grain, pure silicic acid crystals from silicic acid-containing spent lye in cellulose production, whereby the spent lye is alkalized to a pH of at least 11 through the addition of lye and whereby the desilicification, through lowering the pH by exposure to a gas comprising $CO_2$ is carried out in at least two precipitation vessels until the desired residue of silicic acid is obtained and the precipitated silicic acid is separated from the spent lye by sedimentation, characterized in that the alkalized spent lye is inoculated with coarse-grain silicic acid and its pH is then lowered to about 9, and in that sludge produced as the pH is lowered to about 9 is separated during its sedimentation into coarse grain and fine grain silicic acid with a small mount of lignin and into lignin-containing spent lye free of silicic acid, and in that the coarse grain silicic acid is separated from the lignin and the separated lignin is added to the lignin-containing spent lye.

15. The process as in claim 13 in which the coarse grain silicic acid is separated from the lignin in a washing device.

* * * * *